US009089868B2

(12) United States Patent
Lee et al.

(10) Patent No.: US 9,089,868 B2
(45) Date of Patent: Jul. 28, 2015

(54) SPUIT TYPE COSMETIC CONTAINER

(75) Inventors: Do Hoon Lee, Incheon (KR); Jae Kwang Hwang, Seoul (KR)

(73) Assignees: Pum-Tech Korea Co., LTD, Bupyeong-gu, Incheon (KR); F.S Korea Industries Inc., Gangbuk-gu, Seoul (KR)

( * ) Notice: Subject to any disclaimer, the term of this patent is extended or adjusted under 35 U.S.C. 154(b) by 304 days.

(21) Appl. No.: 13/809,733

(22) PCT Filed: Jun. 10, 2011

(86) PCT No.: PCT/KR2011/004261

§ 371 (c)(1),
(2), (4) Date: Jan. 11, 2013

(87) PCT Pub. No.: WO2012/011663

PCT Pub. Date: Jan. 26, 2012

(65) Prior Publication Data

US 2013/0112314 A1 May 9, 2013

(51) Int. Cl.

| | |
|---|---|
| ***A45D 34/00*** | (2006.01) |
| ***B05B 11/00*** | (2006.01) |
| ***A45D 34/04*** | (2006.01) |
| *A45D 40/26* | (2006.01) |

(52) U.S. Cl.

CPC ..... *B05B 11/309* (2013.01); *A45D 34/04* (2013.01); *A45D 34/045* (2013.01); *A45D 40/26* (2013.01)

(58) Field of Classification Search

CPC ..... A45D 40/26; A45D 34/00

USPC ..... 141/22–24, 90; 222/320, 321.1, 336, 222/342, 630–631

See application file for complete search history.

(56) References Cited

U.S. PATENT DOCUMENTS 2,781,063 A * 2/1957 Williams ..... 141/24
3,101,751 A * 8/1963 Ballin ..... 141/24

(Continued)

FOREIGN PATENT DOCUMENTS

EP 2749187 A1 * 7/2014 ..... A45D 34/00
KR 200467603 Y1 * 6/2013 ..... A45D 34/00

(Continued)

*Primary Examiner* — Nicolas A Arnett

(74) *Attorney, Agent, or Firm* — East West Law Group; Heedong Chae

(57) ABSTRACT

A spuit type cosmetics container includes a main container and a spuit having a spuit tube thread-coupled with the main container. The spuit includes a cap, an up/down button, an elastic member, and a cam encasing the up/down button. One of the up/down button and the cam includes a cam protrusion and the other includes an inclined guide guiding the cam protrusion in an inclined direction such that rotation of the cap is transformed into ascending/descending of the up/down button. The up/down button automatically descends to suction the cosmetics accommodated in the main container into the spuit tube beyond a preset rotation angle when the spuit is thread-coupled with the main container, and automatically ascends to keep the cosmetics suctioned in the spuit tube when the spuit is separated from the main container, resulting in convenient use.

11 Claims, 10 Drawing Sheets

(56) References Cited

U.S. PATENT DOCUMENTS

| | | | | | |
|---|---|---|---|---|---|
| 3,820,576 | A * | 6/1974 | Torrent | 141/24 |
| 4,278,360 | A * | 7/1981 | Lorscheid et al. | 141/18 |
| 4,376,591 | A * | 3/1983 | Proffer | 141/24 |
| 4,579,153 | A * | 4/1986 | Goncalves | 141/23 |
| 5,226,572 | A * | 7/1993 | Gargione | 141/24 |
| 6,112,779 | A * | 9/2000 | Camilla | 141/23 |
| 8,403,008 | B2 * | 3/2013 | Bouix et al. | 141/27 |
| 2013/0074983 | A1 * | 3/2013 | Choi | 141/23 |
| 2013/0192713 | A1 * | 8/2013 | Drugeon et al. | 141/26 |
| 2014/0234007 | A1 * | 8/2014 | Lee | 401/121 |
| 2014/0361047 | A1 * | 12/2014 | Lee et al. | 222/372 |

FOREIGN PATENT DOCUMENTS

| | | | | | |
|---|---|---|---|---|---|
| KR | 101308844 | B1 * | 9/2013 | A45D 34/04 |
| KR | 101322380 | B1 * | 10/2013 | A45D 34/00 |
| KR | 101328457 | B1 * | 11/2013 | A45D 34/00 |
| KR | 200471502 | Y1 * | 2/2014 | A45D 34/00 |
| KR | 101370284 | B1 * | 3/2014 | A45D 34/04 |
| KR | 200472043 | Y1 * | 4/2014 | A45D 34/00 |
| WO | WO2013047989 | A1 * | 4/2013 | A45D 34/00 |
| WO | WO2014054882 | A1 * | 9/2013 | A45D 34/04 |

* cited by examiner

SPUIT TYPE COSMETIC CONTAINER

BACKGROUND OF THE INVENTION

1. Field of the Invention

The present invention relates to a spuit type cosmetics container, and more particularly, to a spuit type cosmetics container having improved structure of suctioning cosmetics that are contained in a main container into a spuit tube and an improved structure of taking the spuit tube from the main container, which are used to extract the cosmetics by a preset quantity with a spuit.

2. Description of the Related Art

High performance cosmetics such as essence eyecream, anti-aging/wrinkle agent are very expensive and packed by a small quantity so that a major of existing cosmetics containers accommodating the cosmetics is also compact. The structure of the cosmetics containers simply includes a container and a cap so that a user gets the contents out through an outlet hole of the container on his/her palms and applies the cosmetics to corresponding spot on the skin. However, it is hart to control the extracted quantity of the cosmetics and the high expensive cosmetics are lost as much as being got on user's palms and wasted.

In order to overcome the above-mentioned problems, a spuit type cosmetic container has been developed and distributed to extract a preset quantity of cosmetics to apply the same to a corresponding spot of skin.

An existing spuit type cosmetics container 10, as illustrated in FIG. 1, includes a main container 20 accommodating cosmetics therein and a spuit 30 inserted into the main container 20 and sealing the main container 20.

The main container 20 includes male threads 21*a* formed on the outer circumference of an opening 21 to be screw-coupled with the spuit 30. The spuit 30 includes a cap 31 formed with female threads 31*a* corresponding to the male threads 21*a*, a spuit tube 33 coupled with the cap 21 to go into and out the main container 20 through the opening 21, a push button 35 spaced apart from the top of the cap 31, and an elastic member 37 such as a spring disposed between the push button 35 and the cap 31.

However, according to the existing spuit type cosmetics container 10, a user should couple the spuit 30 with the main container 20, push the push button 35 once, separate the spuit 30 from the main container 20 by turning the spuit 30, and push the push button 35 again, so that it is very complicated and inconvenient to use the existing cosmetics container 10.

Moreover, a user may impatiently push the push button 35 before the spuit 30 is completely coupled with the main container 20 for the purpose of suctioning the cosmetics accommodated in the main container 20 into the spuit tube 33, resulting in a small quantity of the cosmetics less than a preset quantity gathered in the spuit tube 33.

Moreover, the existing spuit type cosmetic container 10 has drawbacks such that the cosmetics remain in the spuit tube 33 when the cosmetics are extracted out of the main container 20 through the spuit 30 so that the cosmetics may be lost.

Furthermore, since the cosmetics may be stuck user's body or cloths after taking the spuit tube 33 out of the main container 20 while the cosmetics remain in the spuit tube 33, it may be inconvenient to use.

BRIEF SUMMARY OF THE INVENTION

The present invention has been made to overcome the above problem and provide a spuit type cosmetic container including an improved structure of suctioning cosmetics that are accommodated in a main container into a spuit tube when the cosmetic are extracted with a spuit so that it is convenient to use.

The present also provides an improve cosmetics container of extracting a preset quantity of cosmetics that are accommodated in a main container under a preset condition regardless of user's habit.

The present invention also provides an improved spuit type cosmetic container in which cosmetics may be prevented from being applied to a spuit tube.

In order to achieve the foregoing and/or other aspects of the present invention, there is provided a spuit type cosmetics container including a main container having an opening and a spuit having a spuit tube going into and out the main container through the opening and thread-coupled with the main container, characterized in that: the spuit includes a cap with which the spuit tube is coupled, an up/down button spaced apart from the top side of the cap, an elastic member disposed between the up/down button and the cap, and a cam encasing the up/down button; and one of the up/down button and the cam includes a cam protrusion and the other includes an inclined guide guiding the cam protrusion in an inclined direction such that rotation of the cap is transformed into ascending/descending of the up/down button.

Here, the cam protrusion is formed on the up/down button and the inclined guide is formed on the cam.

The cap includes an inner cap including a vertical guide to guide the cam protrusion vertically as the cam protrusion is guided by the inclined guide when the cap is rotated for the thread coupling with the main container, and an outer cap coupled with the inner cap and encasing the cam such that the cam is disposed between the outer cap and the inner cap.

The elastic member may be a spring.

The elastic member is made of one of elastic material such as rubber, nitrile-Butaniene Rubber (NBR), and silicone.

The suit type cosmetic container may further include a wiper disposed in the main container to wipe cosmetics stuck on the spuit tube.

The wiper extends inwardly to the lower side of the main container and has a cylindrical shape with a punctured lower center to be in contact with the outer circumference of the spuit tube.

The wiper includes a coupler coupled along the circumference of the opening.

The spuit type cosmetics container further includes an auxiliary wiper not coupled with the opening but the inside of the main container and has a disc-shaped center.

The wiper comprised a coupler not coupled with the opening but the inside of the main container.

The wiper extends inwardly to the lower side of the main container and comprises a plurality of radially cutting portions from the lower center to be in contact with the outer circumference of the spuit tube.

The wiper extends inwardly to the lower side of the main container and comprises a cone-shaped punctured lower center to be in contact with the outer circumference of the spuit tube.

The wiper comprises collectors formed on the lateral side thereof by a preset interval to collect the cosmetics remaining on the outer surface of the spuit tube due to weight of the cosmetics to the lower side of the wiper.

Effect of the Invention

According to the spuit type cosmetics container of the present invention, the up/down button automatically descends to suction the cosmetics accommodated in the main container into the spuit tube beyond a preset rotation angle when the spuit is thread-coupled with the main container, and automatically ascends to keep the cosmetics suctioned in the spuit tube when the spuit is separated from the main container, resulting in convenient use.

Moreover, the stroke on which up/down button automatically ascends and descends is so uniform that a preset quantity of the cosmetics accommodated in the main container can be extracted.

In addition, a minimum quantity of cosmetics is applied to the spuit tube so that loss of the cosmetics can be minimized.

Furthermore, it is convenient to use because the cosmetics are not applied to user's body and/or cloths after taking out the spuit.

DETAILED DESCRIPTION OF THE INVENTION

Hereinafter, the embodiment of the present invention will be described in detail with reference to the accompanying drawings.

Figure 1:
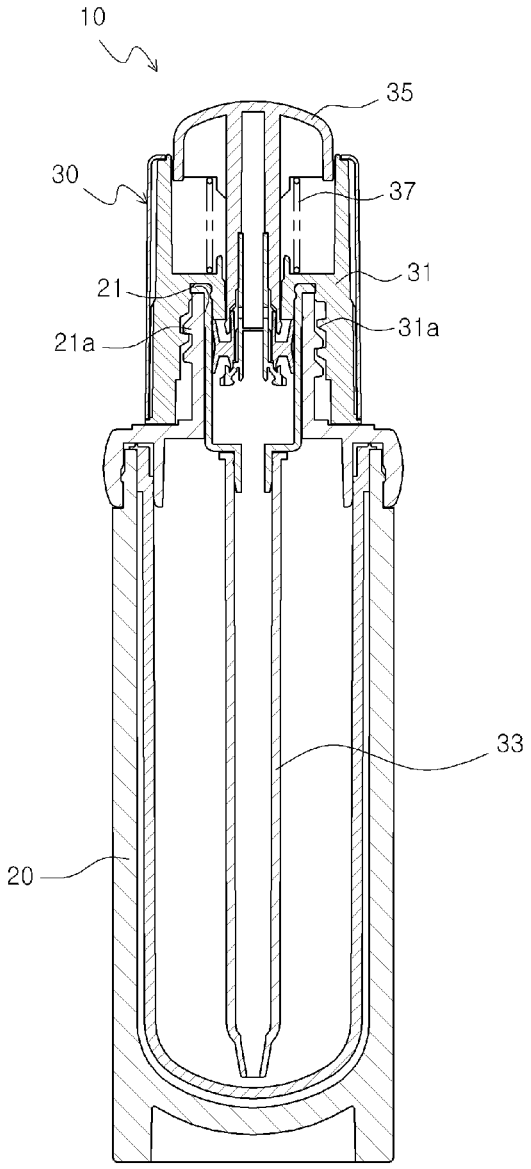
FIG. 1 is a sectional view illustrating an existing spuit type cosmetic container.
Figure 2:
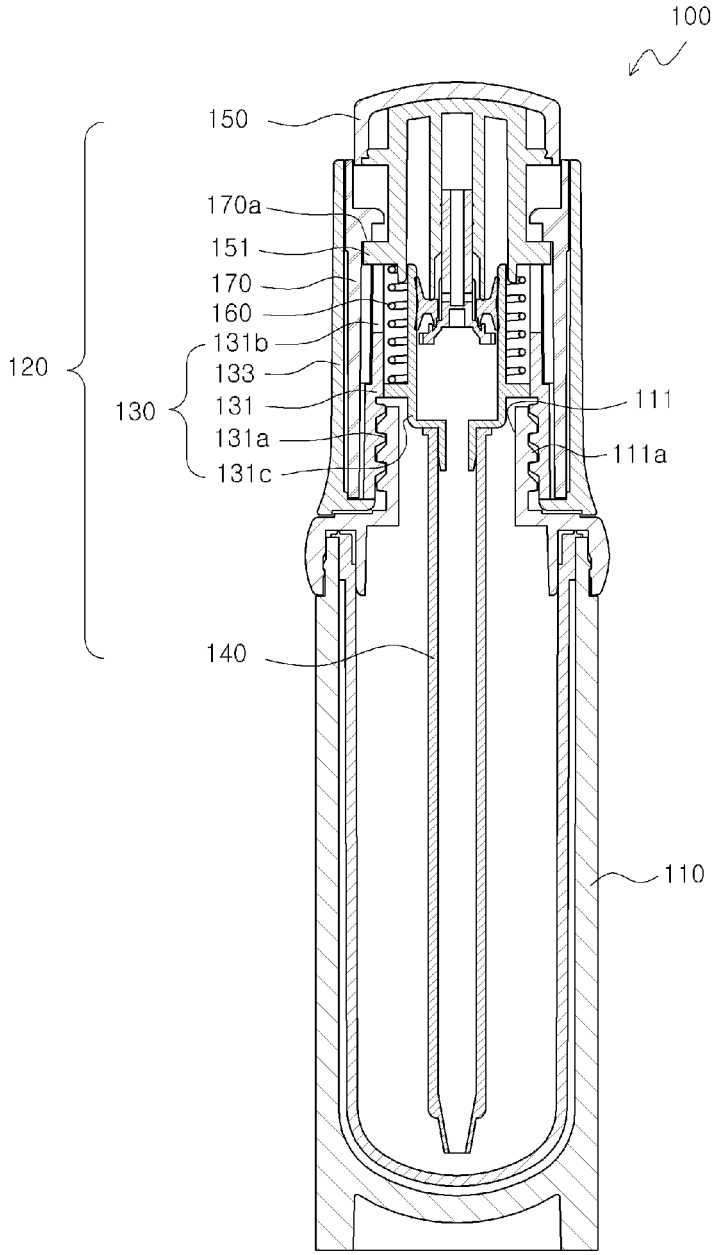
FIG. 2 is a sectional view illustrating a spuit type cosmetics container without a wiper according to an embodiment of the present invention.

A spuit type cosmetics container 100 according to an embodiment of the present invention includes, as illustrated in FIG. 2, a main container 110 accommodating cosmetics therein and having an opening 111 formed at the top thereof and a spurt 120 partially inserted into the main container 110 and thread-coupled with the main container 110 to seal the opening 111.

Figure 3:
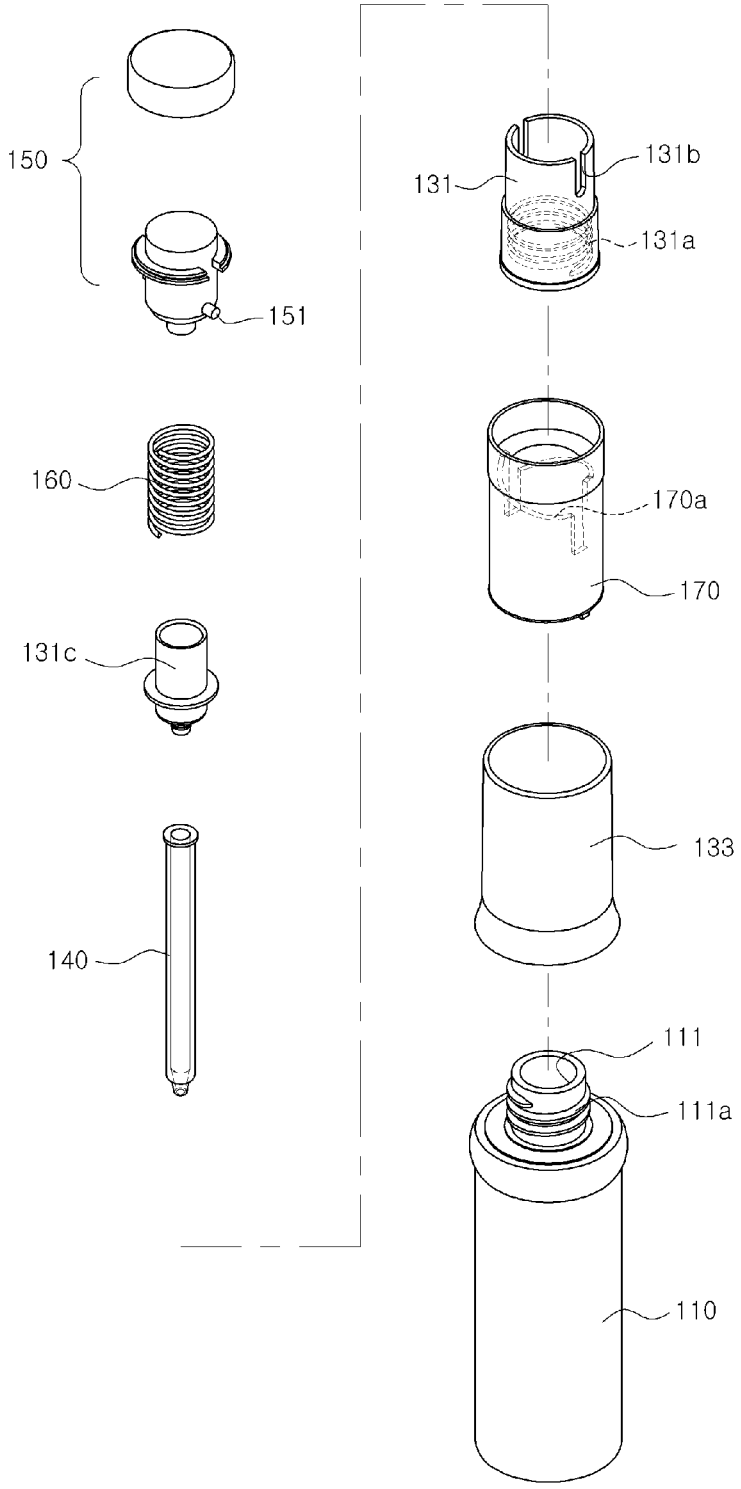
FIG. 3 is an exploded perspective view of the spuit type cosmetics container according to the embodiment of the present invention as shown in FIG. 2.

The main container, as illustrated in FIGS. 2 and 3, includes male threads 111*a* formed on the outer circumference of the opening 111 to be thread-coupled with the spuit 120.

The spuit 120, as illustrated in FIG. 2, includes a cap 130, a spuit tube 140 coupled with the cap 130 and going into and out the main container through the opening 111, an up/down button 150 spaced apart from the top of the cap 130, an elastic member 160 disposed between the up/down button 150 and the cap 130, and a cam 170 encasing the up/down button 150.

In the spurt 120, as illustrated in FIGS. 2 and 3, a cam protrusion 151 is formed on any one of the up/down button 150 and the cam 170 and an inclined guide 170*a* is formed on the other to guide the cam protrusion 151 in an inclined direction, resulting in transforming rotation of the cap 130 into ascending and descending of the up/down button 150.

Figure 4:
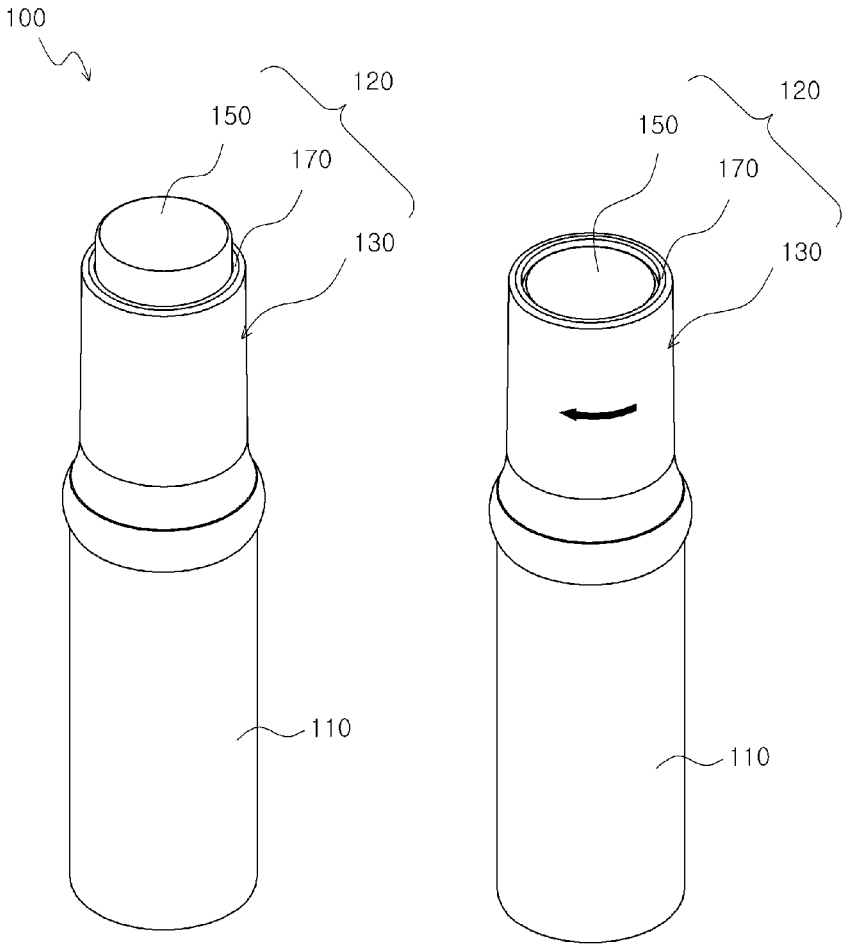
FIG. 4 is a perspective view illustrating assemblies of the spuit type cosmetic container showing the operating state thereof as shown in FIG. 2.

By doing so, as illustrated in FIG. 4, the up/down button 150 descends to suction the cosmetics accommodated in the main container 110 into the spuit tube 140 beyond a preset rotation angle when the spuit 120 is thread-coupled with the main container 110, and ascends again to keep the cosmetics suctioned into the spuit tube 140 therein when the spuit 120 is separated from the main container 110.

As illustrated in FIG. 3, it is preferred that the cam protrusion 151 is formed in the up/down button 150 and the inclined guide 170*a* is formed at the cam 170. Preferably, the inclined guide 170*a* protrudes from an inner planar surface of the cam 170 such that the cam protrusion 151 is engaged with the lower side thereof. Although the inclined guide 170*a* forms an inclined line without a curve in this embodiment, the inclined guide 170*a* may form a stepped inclined line in another embodiment or may be depressed or punched from the inner planar surface of the cam 170.

The cap 130, as illustrated in FIGS. 2 and 3, includes an inner cap 131 with which the spuit tube 140 is coupled and in which female threads 131*a* corresponding to the male threads 111*a* are formed and an outer cap 133 coupled with the inner cap 131 to encase the cam 170 such that the cam 170 is disposed between the inner cap 131 and the outer cap 133.

The inner cap 131, as illustrated in FIG. 3, includes a vertical guide 131*b* vertically punctured to guide the cam protrusion 151 as the cam protrusion 151 is guided by the inclined guide 170*a* when the cap 130 is rotated for the thread-coupling with the main container 110 and a spuit tube mount 131*c* with which the spuit tube 140 is directly coupled.

By doing so, as illustrated in FIGS. 2 to 4, when the spuit tube 140 is inserted into the main container 110 through the opening 111, for the coupling of the spuit 120 with the main container 110, and a user rotating the outer cap 133 at the outermost the female threads 131*a* of the spuit 120 are placed on the male threads 111*a* of the main container 110, the inner cap 131 coupled with the outer cap 131 rotates but the cam 170 is relatively fixed so that the cam protrusion 151 formed on the up/down button is guided along the inclined line by the inclined guide 170*a* formed on the cam 170 and at the same time descends along the vertical guide 131*b* formed on the inner cap 131, so that the user can lower the up/down button 150 gradually without pressing the up/down button 150.

The spuit tube mount 131*c*, as illustrated in FIG. 3, preferably has a hollow cylindrical upper side through which air in the spuit tube 140 enters and exits as the up/down button 150 ascends and descends such that internal pressure of the spuit tube 140 may be increased or decreased.

Although the separated spuit tube mount 131*c* is provided for the easy production and assembly in this embodiment, in another embodiment, the spuit tube mount 131*c* may be integrally formed with the body of the inner cap 131 in which the female threads 131*a*. Although the up/down button 150 includes several separated components for the easier production and assembly, the up/down button 150 may be integrated with the components.

The elastic member 160, as illustrated in FIGS. 2 and 3, is disposed between the up/down button 150 and the inner cap 131 and may be preferably a spring.

By doing so, when the outer cap 133 is rotated again in the reverse direction for extraction of the spuit tube 140 from the main container 110 after the up/down button 150 descends to the limit by rotating the outer cap 133 fully, the elastic member 160 which has been pressed by the descend of the up/down button 150 is gradually restored to the original state due to the elastic restoring force and may raise the up/down button 150 to the original position while the female threads 131*b* of the inner cap 131 are separated from the male threads 111*a*.

Figure 5:
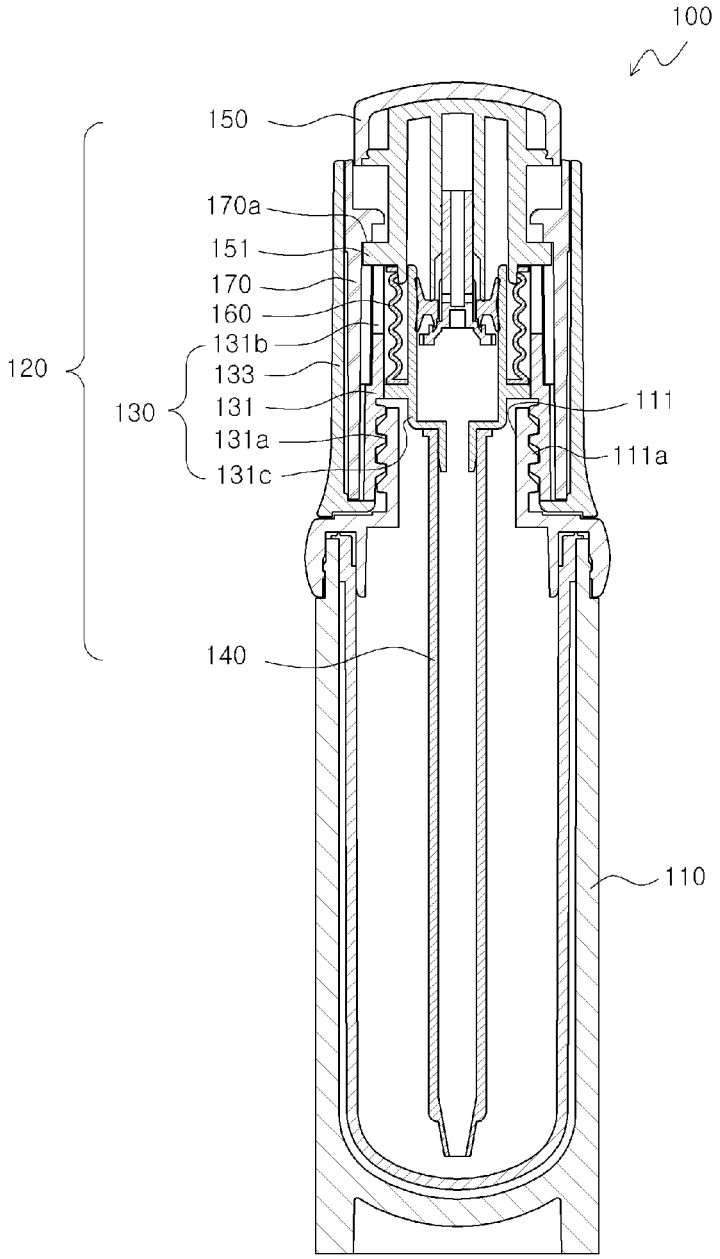
FIG. 5 is a sectional view illustrating a spuit type cosmetic container with an elastic member according to another embodiment of the present invention.

Although the elastic member 160, as illustrated in FIG. 2, is a spring made of various material such as metal, plastic, etc., in this embodiment, the elastic member 160, as illustrated in FIG. 5, may be a member made of, for example, rubber, Nitrile-Butadiene Rubber (NBR), or silicon in anther embodiments. In this case, the elastic member 160 may have various shapes, preferably a bellows shape. Moreover, although the elastic member 160 is separated from the up/down button 150 in this embodiment, the elastic member 160 may be integrally formed with the up/down button 150. That is, both of the elastic member 160 and the up/down button 150 may be integrally formed off various elastic materials such as rubber, NBR, or silicone.

From this configuration, the manufacturing process of the spuit type cosmetics container according to the embodiment of the present invention will be described with reference to FIGS. 2 to 4 as follows.

First, the main container 110 in which the opening 111 is formed at the top side and the male threads 111*a* formed on the outer circumference of the opening 111 is prepared.

Next, the cam 170 encases the up/down button 150 such that the cam protrusion 151 of the up/down button 150 is engaged with the inclined guide 170*a* of the cam 170 and the elastic member 160 is inserted into the cam 170 such that a side thereof is in contact with the up/down button 150.

The spuit tube 150 is coupled with the inner cap 131 in which the female threads 131*a* and the vertical guide 131*b* are formed and the inner cap 131 is inserted into the cam 170 such that the other side of the elastic member 160 is in contact with the inner cap 131 and at the same time the cam 170 encases the inner cap 131.

Finally, the cam 170 and the inner cap 131 are inserted in the outer cap 133 such that the outer cap 133 encases the cam 170 and at the same time the outer cap 133 is coupled with the inner cap 131.

By doing so, when the outer cap 133 of the spuit 120 is rotated such that the completed spuit 120 is thread-coupled with the main container 110, the up/down button 150 automatically descends to suction the cosmetics that are accommodated in the main container 110 into the spuit tube 140 beyond a preset rotation angle when the spuit 120 is thread-coupled with the main container 110 and automatically ascends to keep the cosmetics suctioned into the spuit tube 140 when the spuit 120 is separated from the main container 110, so that it is convenient to use.

Moreover, since the stroke along which the up/down button 150 automatically ascends and descend is uniform, a preset quantity of cosmetics accommodated in the main container 110 can be extracted.

Meanwhile, the spuit type cosmetic container 100 according to the embodiment of the present invention, as illustrated in FIG. 5, preferably further includes a wiper 180 disposed in the main container 110 to wipe out cosmetics stuck on the spuit tube 140.

Several embodiments of the wiper 180 will be described in detail with reference to the accompanying drawings.

Prior to the description, it is noted that same reference numerals are assigned to same elements in several embodiments and their descriptions will be omitted excluding the representative description in first embodiment.

Embodiment 1

Figure 6:
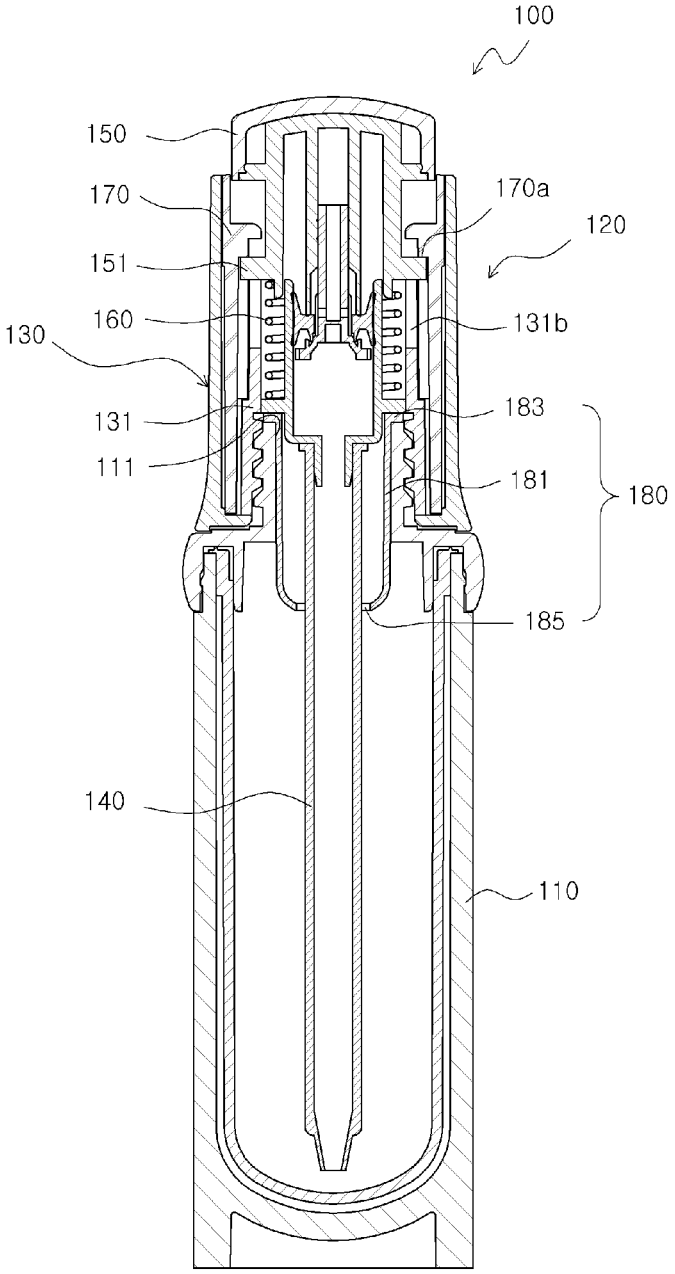
FIG. 6 is a sectional view illustrating a spuit type cosmetic container according to an embodiment of the present invention.
Figure 7:
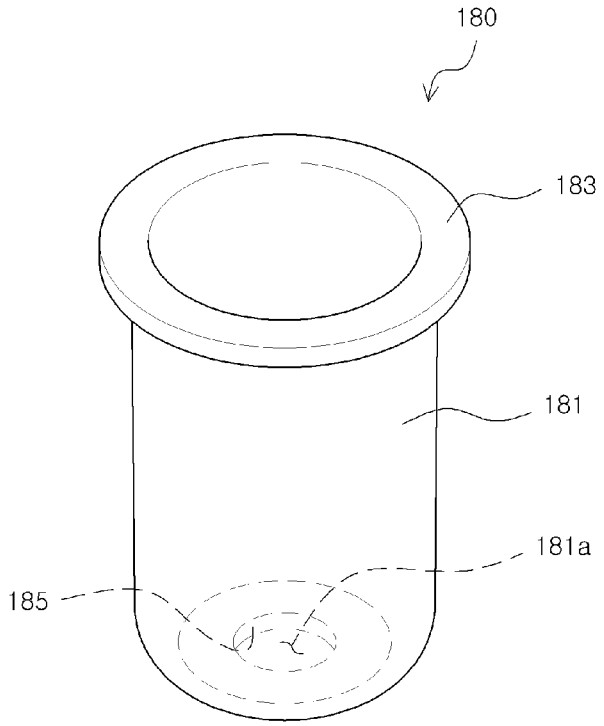
FIG. 7 is a perspective view illustrating a wiper as shown in FIG. 6.

A wiper 180 of a spuit type cosmetics container 100 according to a first embodiment of the present invention, as illustrated in FIGS. 5 and 6, includes a cylindrical wiper body 181 extending inwardly to the lower side of the main container 110 and having a punctured portion 181*a* punctured at the lower center to be in contact with the outer surface of the spuit tube 140, a coupler 183 disposed to the wiper body 181 and coupled with the main container 110 along the circumference of the opening 111, and a contact 185 forming an end of the punctured portion 181*a* of the wiper body 181 and being in direct contact with the outer circumference of the spuit tube 140.

The coupler 183 of the wiper 180 is integrally formed with the wiper body 181, but may be separated from the wiper body 181 to be coupled therewith.

Meanwhile, the contact 185 of the wiper 180 has a vertical cross-section, but may have a stepped cross-section or a round cross-section.

By doing so, it is possible to minimize the cosmetics stuck to the spuit tube 140 when the spuit 120 is extracted from the main container 110 so that the loss of the cosmetics can be minimized.

From this configuration, the process of extracting the spuit when the preset quantity of cosmetics is extracted from the spuit type cosmetics container 100 according to the first embodiment of the present invention will be described with reference to FIGS. 5 and 6, as follows.

First, when a user rotates the cap 130 such that the main container 110 is coupled with the spuit 120, the up/down button descends and is automatically pressed beyond a preset rotation angle and the cosmetics accommodated in the main container 110 is suctioned up into the spuit tube 140.

Next, when the cap 130 is rotated in the opening direction while the up/down button 150 of the spuit 120 is pressed, the up/down button 150 gradually ascends and the spuit 120 is extracted from the main container 110.

In this case, the spuit tube 140 is extracted to the upper side of the wiper 180 through the punctured portion 181*a* of the wiper 180 such that the end of the spuit tube 140 moves toward the opening 111 of the main container 110 and the contact 185 of the wiper 180 is in direct contact with the outer surface of the spuit tube 140 so that the cosmetics stuck on the outer circumference of the spuit tube 140 is wiped by wiper 180.

By doing so, it is possible to minimize the cosmetics to stick on the spuit tube 140 so that the loss of the cosmetics can be minimized, and the cosmetics are not applied to the cloths and user's body after extraction of the spuit 120 so that it is convenient to use.

Embodiment 2

Figure 8:
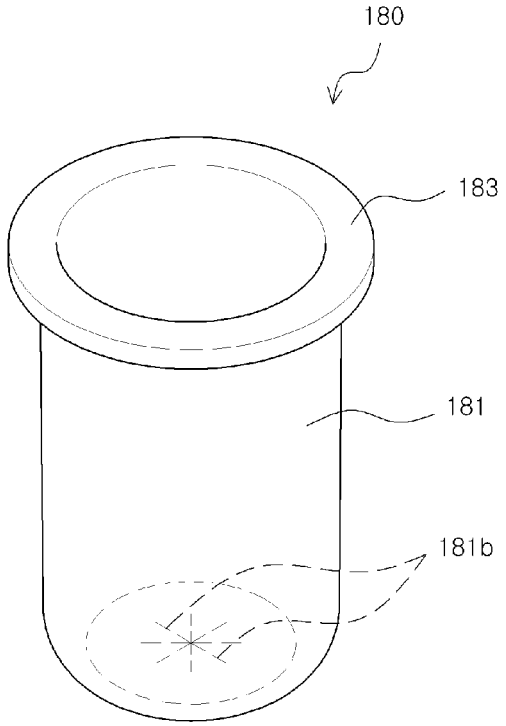
FIG. 8 is a perspective view illustrating a wiper according to another embodiment of the present invention.

A spuit type cosmetics container 100 according to a second embodiment of the present invention, as illustrated in FIG. 8, is different from the spuit type cosmetics container according to the first embodiment in view that a wiper 180 extends inwardly to the lower side of the main container 110 and includes a plurality of radially cutting portions 181*b* from the lower center of the wiper body 181 to be in contact with the outer surface of the spuit tube 140.

By doing so, since only the cutting portions 181*b* are formed on the lower side of the wiper body 181, the wiper 180 may be prepared in more convenient way and a simple structured wiper 180 may be prepared by which the functions of the punctured portion 181*a* and the contact 185 are replaced by the cutting portions 181*b*. Moreover, the punctured portion 181*a* is prepared to prevent material from be wasted.

Meanwhile, elements not described with reference to FIG. 8 are similar to those in the first embodiment and their descriptions will be omitted.

Embodiment 3

Figure 9:
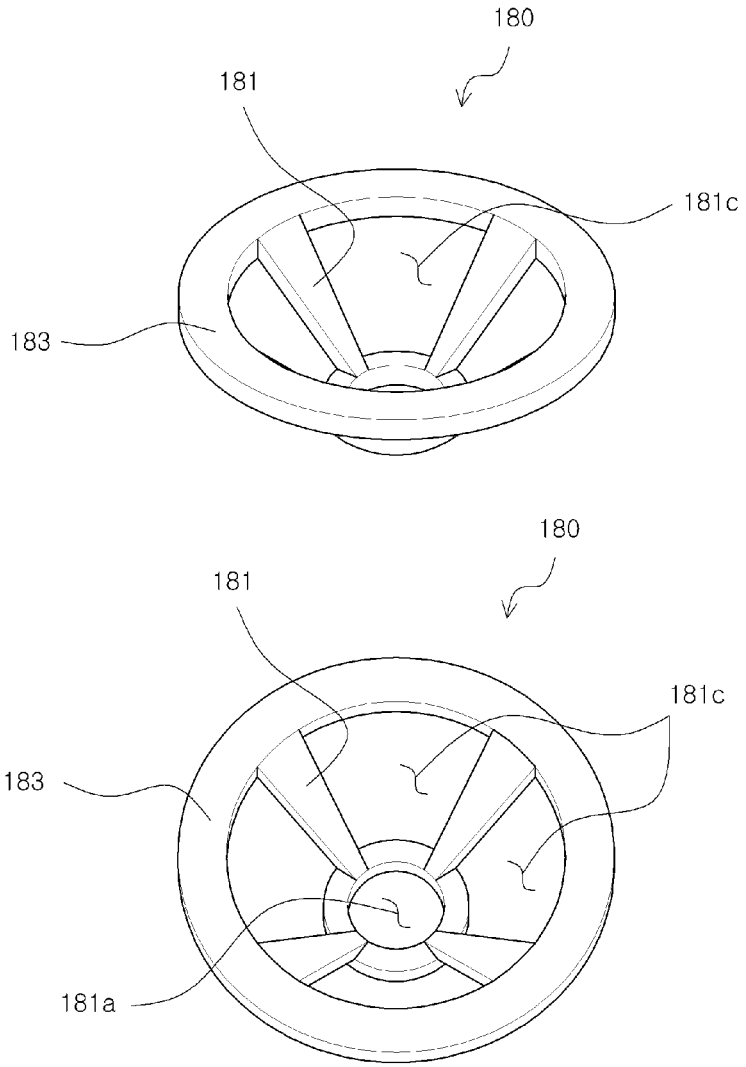
FIG. 9 is a perspective view illustrating a wiper according to still another embodiment of the present invention.

A spuit type cosmetics container 100 according to a third embodiment of the present invention, as illustrated in FIG. 9, is different from those in the first and second embodiments in view that a wiper 180 extends inwardly to the lower side of the main container 110 has a cone shaped punctured lower center to be in contact with the outer surface of the spuit tube 140 and cosmetics collectors 181*c* punctured on the lateral side of the wiper body 181 by a preset interval to collect the cosmetics to the lower side of the wiper 180 due to the weight of the cosmetics remaining on the outer surface of the spuit tube 140.

By doing so, after the outer surface of the spuit tube 140 is cleaned by the wiper 180, the cosmetics remaining on the outer surface of the spuit tube 140 is collected by the cosmetics collectors 181*c* so that the loss of the cosmetics can be minimized.

Meanwhile, elements not described with reference to FIG. 9 are similar to those in the first embodiment and their descriptions will be omitted.

Embodiment 4

Figure 10:
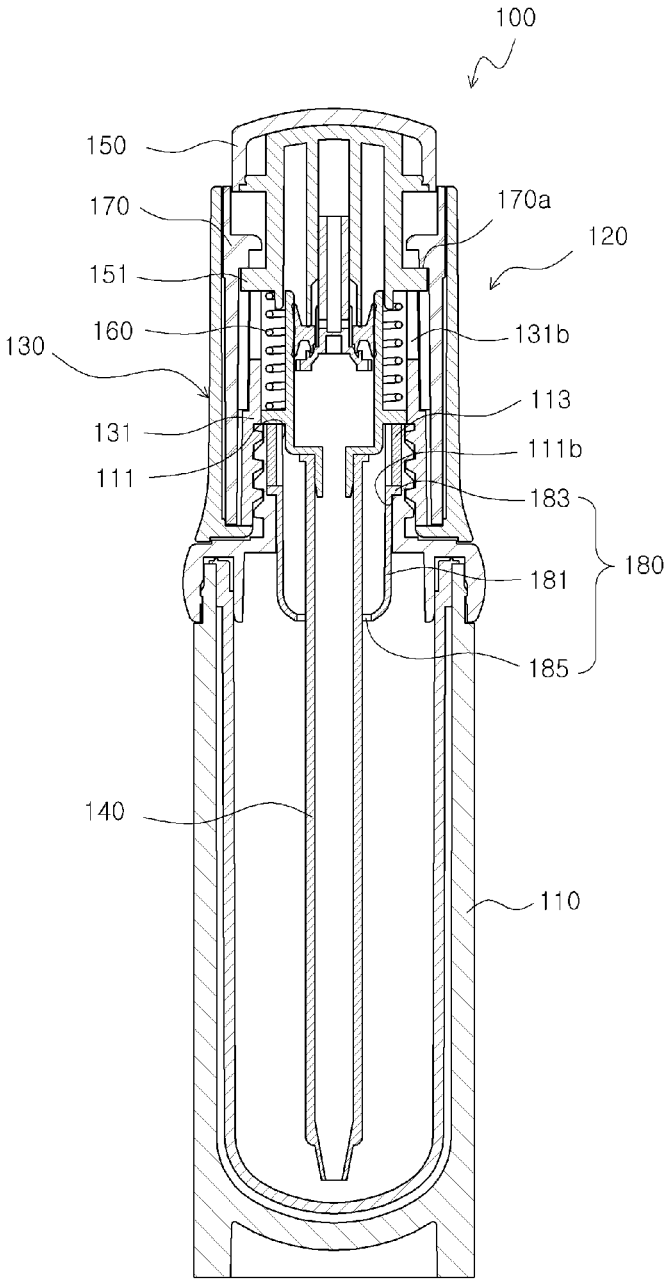
FIG. 10 is a sectional view illustrating a spuit type cosmetics container according to still another embodiment of the present invention.

As spuit type cosmetics container 100 according to a fourth embodiment of the present invention, as illustrated in FIG. 10, is different from those of the first to third embodiments of the present invention in view that coupler 183 of a wiper 180 is not coupled with the opening 111 of the main container 110 but inside thereof.

The coupler 183 of the wiper 180 is seated on a wiper seating step 111*b* formed in the main container 110 and is fixed by a ring shaped opening member 113 to be inserted thereinto from the upper side of the coupler 183.

By doing so, the coupler 183 of the wiper 180 is not exposed to the outside and an improved aesthetica) appearing can be provided, and it is possible to prevent the wiper 180 from being easily separated from the main container 110.

Meanwhile, elements not described with reference to FIG. 10 are similar to those in the first to third embodiments and their descriptions will be omitted.

Embodiment 5

Figure 11:
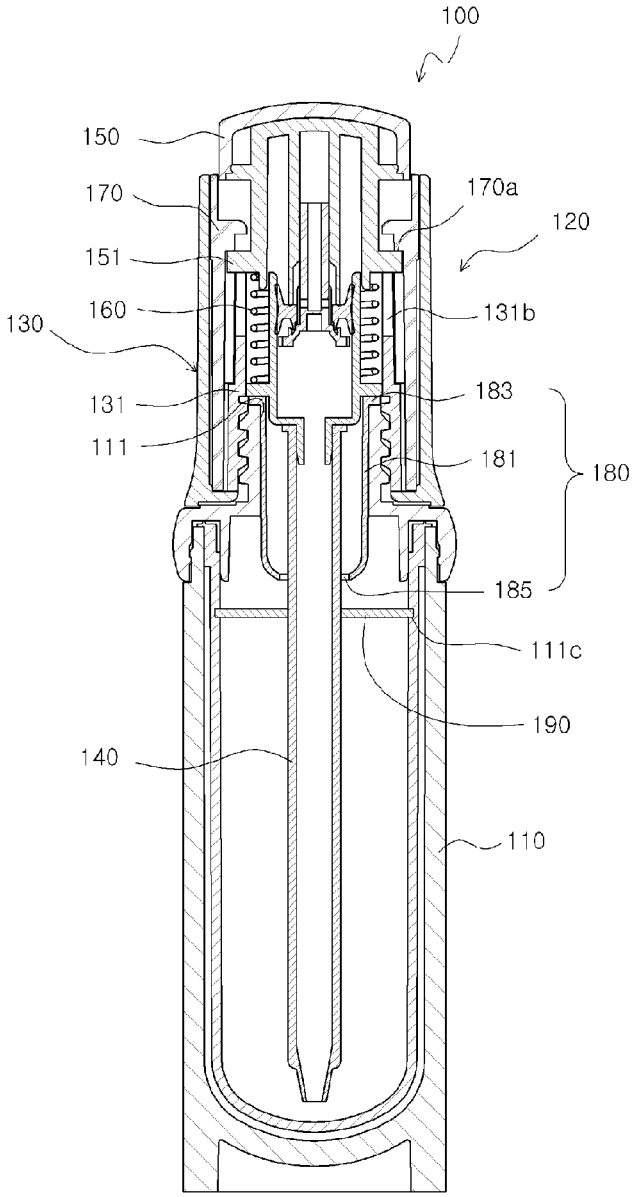
FIG. 11 is a sectional view illustrating a spuit type cosmetics container according to still another embodiment of the present invention.
Figure 12:
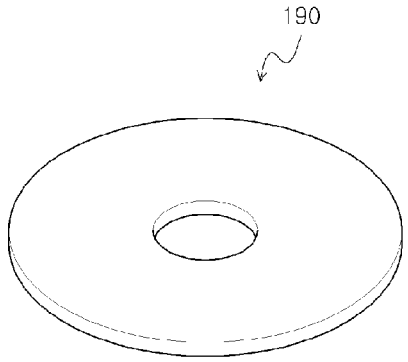
FIG. 12 is a perspective view illustrating an auxiliary wiper as shown in FIG. 11.

A spuit type cosmetics container 100 according to a fifth embodiment of the present invention, as illustrated in FIGS. 11 and 12, is different from those of the first to fourth embodiments of the present invention in view of further including a disc-shaped auxiliary wiper 190 not coupled with the opening 111 but the inside of the main container 110 and having a punctured center.

The auxiliary wiper 190 is inserted into an auxiliary wiper coupling recess 111*c* formed inside the main container 110 and several auxiliary wipers 190 may be provided.

By doing so, the spuit tube 140 is washed repeatedly by the auxiliary wiper 190 and the wiper 180 whenever the spuit tube 140 is extracted from the main container 110 so that the cosmetics stuck on the outer surface of the spuit tube 140 can be more clearly washed.

Meanwhile, elements not described with reference to FIGS. 11 and 12 are similar to those in the first to fourth embodiments and their descriptions will be omitted.

Therefore, according to the present invention, it is possible to minimize the cosmetics to stick on the spuit tube 140 so that the loss of the cosmetics can be minimized.

At least two of the respective embodiments may be applied together as occasion demands.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Therefore, the foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

Description of Reference Numerals for Main Components of the Drawings

| | |
|---|---|
| 100: spuit type cosmetics container | 110: main container |
| 111: opening | 120: spuit |
| 130: cap | 131: inner cap |
| 131b: vertical guide | 133: outer cap |
| 140: spuit tube | 150: up/down button |
| 151: cam protrusion | 160: elastic member |
| 170: cam | 170a: inclined guide |
| 180: wiper | 181: wiper body |
| 183: coupler | 185: contact |
| 190: auxiliary wiper | |

What is claimed is:

1. A spuit type cosmetics container comprising a main container having an opening and a spuit having a spuit tube going into and out the main container through the opening and thread-coupled with the main container, characterized in that:

the spuit includes a cap with which the spuit tube is coupled, an up/down button spaced apart from the top side of the cap, an elastic member disposed between the up/down button and the cap, and a cam encasing the up/down button; and one of the up/down button and the cam includes a cam protrusion and the other includes an inclined guide guiding the cam protrusion in an inclined direction such that rotation of the cap is transformed into ascending/descending of the up/down button, wherein the cam protrusion is formed on the up/down button and the inclined guide is formed on the cam, wherein the cap comprises:

an inner cap including a vertical guide to guide the cam protrusion vertically as the cam protrusion is guided by the inclined guide when the cap is rotated for the thread coupling with the main container; and an outer cap coupled with the inner cap and encasing the cam such that the cam is disposed between the outer cap and the inner cap.

2. The spuit type cosmetics container of claim 1, wherein the elastic member comprises a spring.

3. The spuit type cosmetics container of claim 1, wherein the elastic member is made of elastic material selected from the group consisting of rubber, nitrile-Butaniene Rubber (NBR), and silicone.

4. The spuit type cosmetics container of claim 1, further comprising a wiper disposed in the main container to wipe cosmetics stuck on the spuit tube.

5. The spuit type cosmetics container of claim 4, wherein the wiper extends inwardly to the lower side of the main container and has a cylindrical shape with a punctured lower center to be in contact with the outer circumference of the spuit tube.

6. The spuit type cosmetics container of claim 5, wherein the wiper comprises a coupler coupled along the circumference of the opening.

7. The spuit type cosmetics container of claim 5, further comprising an auxiliary wiper not coupled with the opening but the inside of the main container and has a disc-shaped center.

8. The spuit type cosmetics container of claim 5, wherein the wiper comprises a coupler not coupled with the opening but the inside of the main container.

9. The spuit type cosmetics container of claim 4, wherein the wiper extends inwardly to the lower side of the main container and comprises a plurality of radially cutting portions from the lower center to be in contact with the outer circumference of the spuit tube.

10. The spuit type cosmetics container of claim 4, wherein the wiper extends inwardly to the lower side of the main container and comprises a cone-shaped punctured lower center to be in contact with the outer circumference of the spuit tube.

11. The spuit type cosmetics container of claim 10, wherein the wiper comprises collectors formed on the lateral side thereof by a preset interval constructed such that the cosmetics remaining on the outer surface of the spuit tube fall down to the lower side of the wiper due to their own weight.

* * * * *